US005267830A

United States Patent [19]

Wickoren et al.

[11] Patent Number: 5,267,830

[45] Date of Patent: Dec. 7, 1993

[54] PUMP FOR ABRASIVE MATERIALS

[75] Inventors: Dean R. Wickoren, Paola; Richard J. Wickoren, Overland Park; Troy L. Pennington, Olathe; Lawrence E. Klote, Leawood; Lawrence R. Gardner, Spring Hill; Ronald L. Dellinger, Overland Park, all of Kans.

[73] Assignee: Innovative Material Systems, Inc., Olathe, Kans.

[21] Appl. No.: 959,521

[22] Filed: Oct. 13, 1992

Related U.S. Application Data

[63] Continuation of Ser. No. 642,795, Jan. 18, 1991, abandoned.

[51] Int. Cl.[5] ..... F01D 3/02

[52] U.S. Cl. ..... 415/99; 415/102; 415/143; 37/195; 37/320; 37/329; 37/337

[58] Field of Search ..... 415/93, 97, 99, 101, 415/102, 121.3, 143, 200, 225; 37/58, 59, 60, 61, 64, 66, 68, 69, 70, 195

[56] References Cited

U.S. PATENT DOCUMENTS

| | | | |
|---|---|---|---|
| 674,832 | 5/1901 | Berg . | |
| 687,853 | 12/1901 | Richards . | |
| 1,029,554 | 6/1912 | Neumayer . | |
| 1,262,240 | 4/1918 | Okun . | |
| 1,494,642 | 5/1924 | Swintek | 415/99 |
| 1,769,886 | 7/1930 | Moody . | |
| 2,184,496 | 12/1939 | Hale | 415/99 |
| 2,655,869 | 10/1953 | Murphy . | |
| 2,808,782 | 10/1957 | Thompson et al. . | |
| 2,815,716 | 12/1957 | Ransohoff . | |
| 3,196,799 | 7/1965 | Loss . | |
| 3,253,357 | 5/1966 | Allard | 415/122.1 |
| 3,371,614 | 3/1968 | Crisafulli . | |
| 3,583,826 | 6/1971 | Schonwald | 415/143 |
| 4,014,626 | 3/1977 | Grenn . | |
| 4,083,647 | 4/1978 | Tatkov et al. . | |
| 4,526,507 | 7/1985 | Bingler | 415/143 |
| 4,792,275 | 12/1988 | Weinrib . | |
| 4,872,809 | 10/1989 | Addie et al. . | |
| 4,902,199 | 2/1990 | McDonald et al. | 415/99 |

FOREIGN PATENT DOCUMENTS 1435827 11/1988 U.S.S.R. ..... 37/58

OTHER PUBLICATIONS

Issue of World Dredging Mining & Construction, Jan.-/Feb. 1989, pp. 3,5-6.

Issue of World Dredging Mining & Construction, Nov/Dec. 1989, pp. 3, 15-17.

Issue of World Dredging Mining & Construction, Feb. 1990, p. 9.

Pump Application Engineering, Hicks and Edwards, May 1973, pp. 232-233.

*Primary Examiner*—Edward K. Look

*Assistant Examiner*—James A. Larson

*Attorney, Agent, or Firm*—Hovey, Williams, Timmons & Collins

[57] ABSTRACT

A pump for handling abrasive materials includes a housing having two chambers. A shaft mounts a high pressure impeller and a high volume impeller in respective chambers of the housing, each chamber having a separate and opposite inlet. A channel is provided to divert a portion of the flow generated by the high pressure impeller to a purge ring adjacent the primary inlet corresponding to the high volume impeller. The purge ring directs a flow of relatively abrasive-free liquid toward the inlet to reduce wear on the housing and high-volume impeller. Another part of the flow from the high pressure impeller is diverted through the housing to isolate portions of the housing and the high volume impeller from the abrasive material laden intake through the primary inlet. The invention also includes a method of dredging abrasive materials which includes immersing a pump into a liquid in proximity to a deposit of abrasive materials, directing a first flow of liquid containing abrasive materials into a primary inlet of the pump and directing a second, relatively abrasive-free flow of liquid into a secondary inlet, circulating a portion of the abrasive-free flow toward the intake, and combining the first and second flows in the pump before discharging the combined flow to a remote location.

21 Claims, 3 Drawing Sheets

FIG. 1.
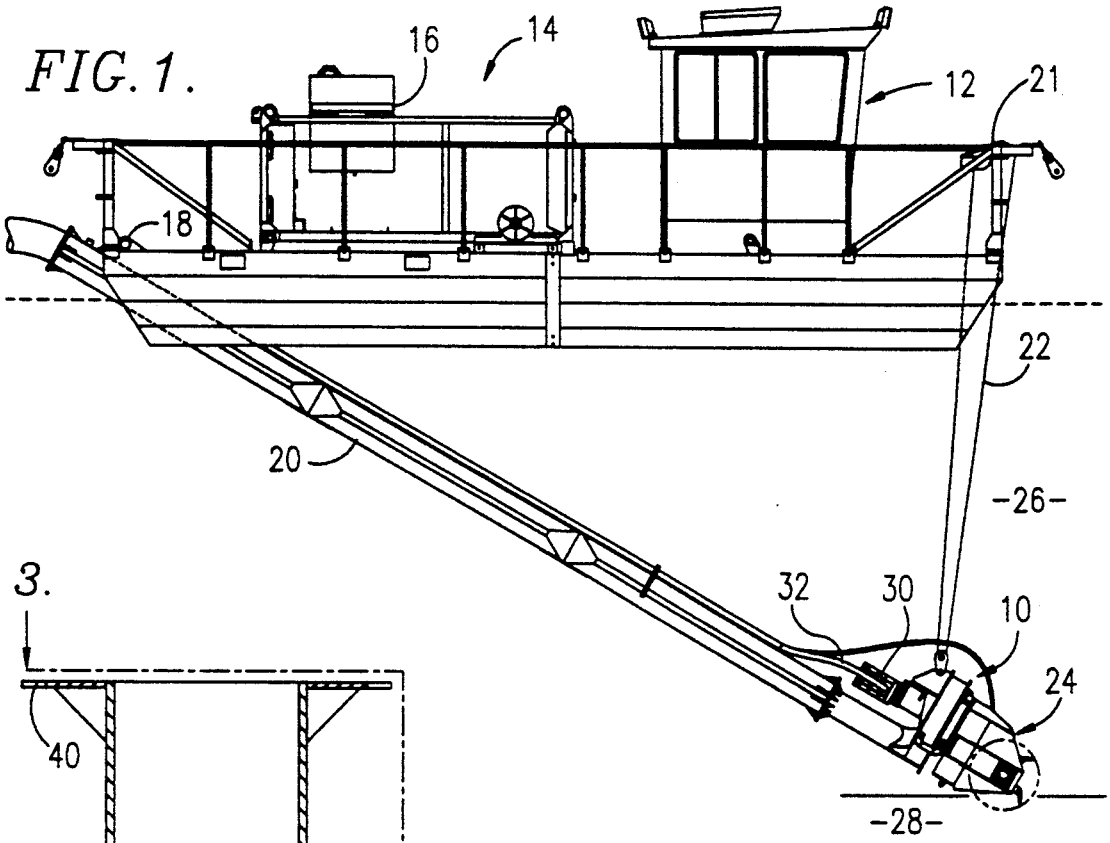
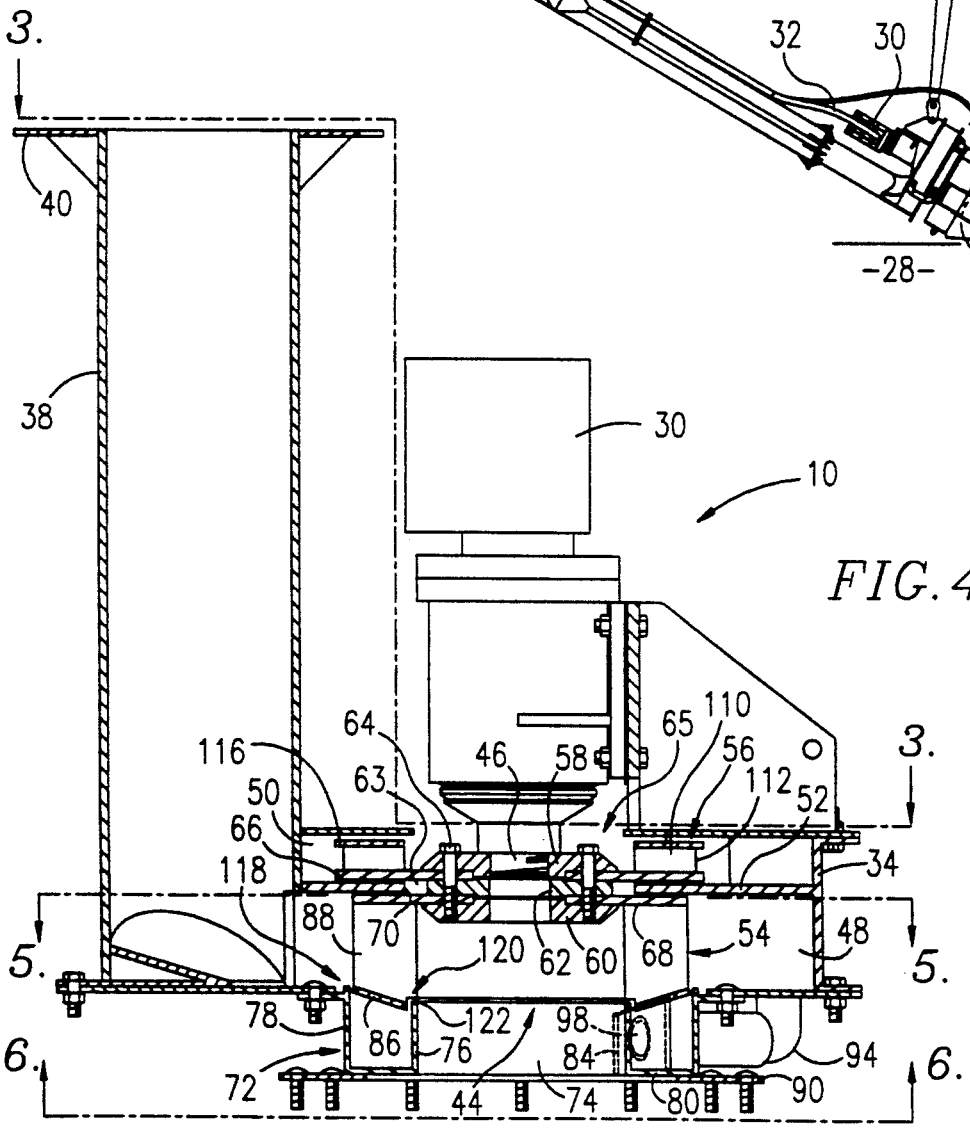
FIG. 4.

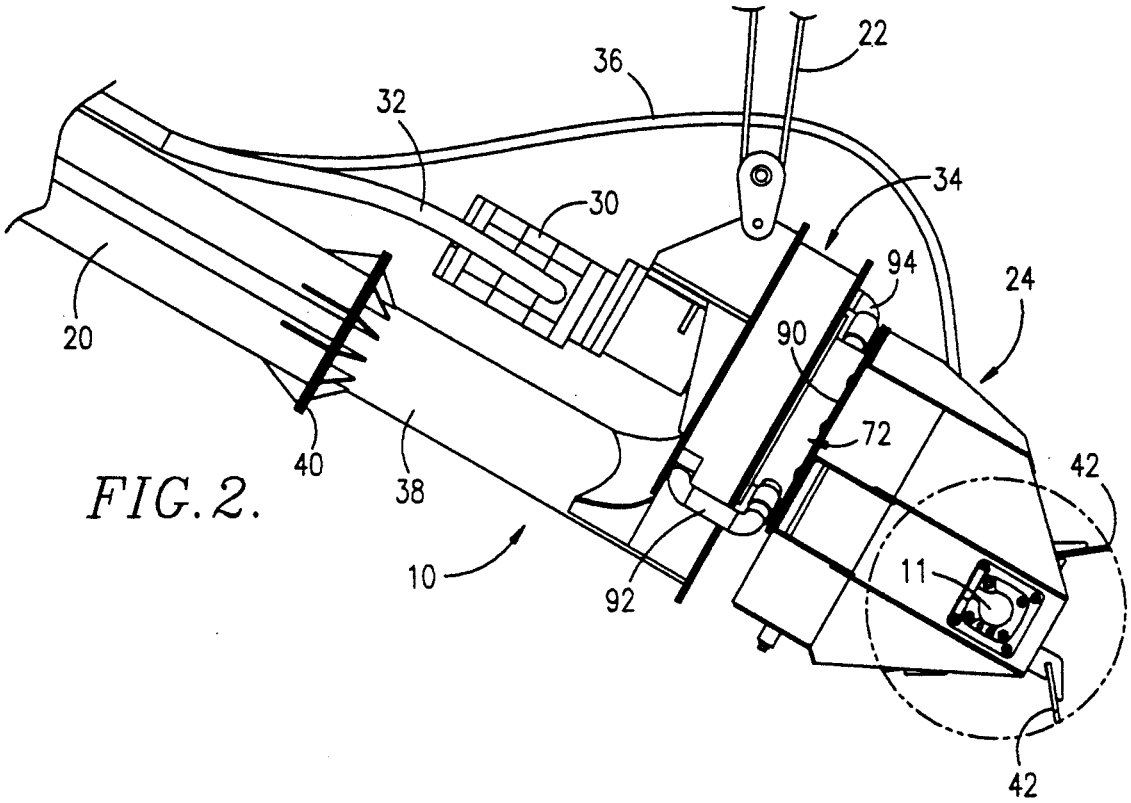
FIG. 2.
FIG. 6..
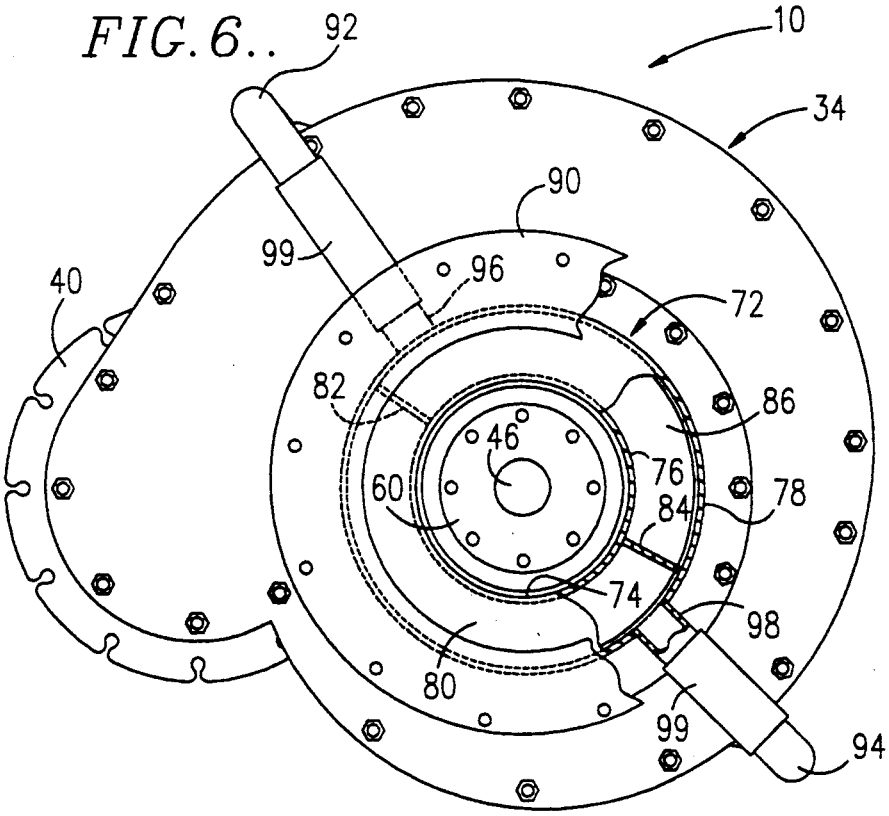

PUMP FOR ABRASIVE MATERIALS

Continuation of application Ser. No. 07/642,795 filed Jan. 18, 1991, abandoned.

BACKGROUND OF THE INVENTION

1. Field of the Invention

This invention concerns a pump which is especially useful for pumping liquids having abrasive materials as a component thereof, and more particularly to a pump which includes two impellers and two intakes, whereby the primary intake receives liquids containing an abrasive material and a secondary intake receives a relatively abrasive-free liquid for circulation to the primary intake to reduce wear on the pump components and help prevent line plugging.

2. Description of the Prior Art

One of the most commonly encountered problems in dredging operations is the wear on the equipment, particularly the pump. At some dredging sites, the sediment or mineral deposit is relatively soft, and thus the abrasive effect of the particulate in the pumped liquid occurs over a greater period of time, while in other environments, such as coral sand, the abrasive effect renders the pump inoperative in only a few hours. Each time the pump must be shut down and repaired or replaced is lost time to the operator and lost income, and lost dredging time once in position represents one of the greatest sources of lost income to operators.

Another problem encountered by pump operators involves choking of the pump by excessive quantities of pumped material accumulating in the pump or in the discharge conduit. The pumps ordinarily employed in dredging operations are submersible and operate in the immediate vicinity of the sand or other material deposit. The material is conventionally pumped to a floating platform and then off to a disposal site. It is to understood that the greater the ratio of sand or other deposit in the discharge flow, the more efficient and thus more profitable the operation. Unfortunately, the pump may be unable to maintain a positive flow if the intake is momentarily blocked when solids have accumulated in the discharge conduit. The weight of the choked discharge conduit may not only cause a shutdown of the dredging operation, but may necessitate abandonment of the discharge conduit.

The approach of pump manufacturers toward the problems of wear due to abrasion have largely focused on building bigger and thus heavier and more expensive pumps. By reinforcing the pump with a greater quantity of material, a longer useful life may be achieved provided that the operator is willing to pay a greater initial cost and for increased horsepower costs to run the heavier equipment. Another approach has been the use of jet pumps which require a great deal of energy to operate. A third solution has been to employ abrasion resistant liners which are subject to the same abrasion as unlined pumps. A fourth approach is exemplified by U.S. Pat. No. 4,872,809 to Addie et al. wherein the specific dimensions of various parts of the pump are controlled.

Each of these different approaches has achieved an increase in the operating life expected of a pump used in pumping abrasive slurries of sand and the like by recognizing that wear will occur and compensating for the abrasive contact between the abrasive material and the pump components. However, there remains a need for a wear resistant pump which remains highly efficient and achieves an even longer life by protecting the components from the abrasive effects of the pumped material rather than treating the symptoms. There also remains a need for a pump which can maintain a flow in a dredging system even when the intake becomes temporarily choked. These objects include maintaining an efficient output from the pump and the ability to use the pump with existing dredging equipment.

SUMMARY OF THE INVENTION

The challenge of solving these problems has largely been met by the pump of the present invention. The pump hereof includes a rotatable shaft mounting two impeller, each having their own intake positioned on different sides of the pump for respectively receiving a primary intake of liquid having a relatively high concentration of abrasive material and a secondary intake of relatively abrasive-free material, thus providing for a sustained flow through the pump and pipeline in the event the primary intake is obstructed. The flow from of the relatively abrasive-free liquid from the secondary intake is preferably channelled to a portion of the housing adjacent the primary intake to isolate the housing and primary impeller from excessive wear.

In greater detail, the primary impeller is configured for high volume flow, while the secondary impeller is designed for a smaller volume of flow at a higher pressure. The higher pressure ensures positive flow of relatively abrasive free liquid to areas of the pump ordinarily subject to contact with an abrasive-laden liquid or slurry during use. The housing of the pump is configured to present two separate chambers. A part of the flow of this relatively abrasive-free liquid is diverted to flow through the pump and around the impellers to further prevent excessive wear. Both the relatively abrasive-free and abrasive-laden flows are combined to flow through a common discharge outlet. Thus, even though the primary intake becomes blocked, flow through the pump and pipeline will be maintained and the pipeline is thus highly resistant to choking.

The invention hereof also includes a method of dredging abrasive materials which includes submersing a pump into a liquid in proximity to a deposit of abrasive laden material, receiving a first flow of abrasive laden material into a primary inlet of the pump, receiving a second flow of relatively abrasive-free liquid into a secondary inlet of the pump, circulating a portion of the relatively abrasive-free flow toward the primary inlet and combining both of the flows for producing a combined discharge. The method also preferably includes directing a part of the relatively abrasive-free flow through the housing of the pump for reducing wear on the pump during operation. The method also preferably includes rotating a cutterhead in proximity to the deposit for disrupting the deposit and thereby routing a portion of the disrupted deposit into the primary inlet for pumping.

BRIEF DESCRIPTION OF THE DRAWINGS

FIG. 1 is a right side elevation of a floating dredge showing the pump of the present invention immersed in a liquid and connected to a discharge conduit for pumping a slurry of liquid and abrasive material;

FIG. 2 is an enlarged, fragmentary right side elevational view of the pump as shown in FIG. 1, with the present invention showing a hydraulic motor for powering the pump and a rotatable cutterhead positioned adjacent the primary pump inlet;

FIG. 4 is an enlarged vertical cross-sectional view taken along line 3—3 of FIG. 3 showing the primary and secondary impellers and the purge ring surrounding the primary inlet;

FIG. 6 is a bottom plan view of the pump hereof with portions of the channel from the upper chamber of the housing and portions of the purge ring adjacent the primary inlet shown in phantom and portions of the bottom cover removed to show a barrier across the annular opening in the purge ring.

DESCRIPTION OF THE PREFERRED EMBODIMENT

Figure 5:
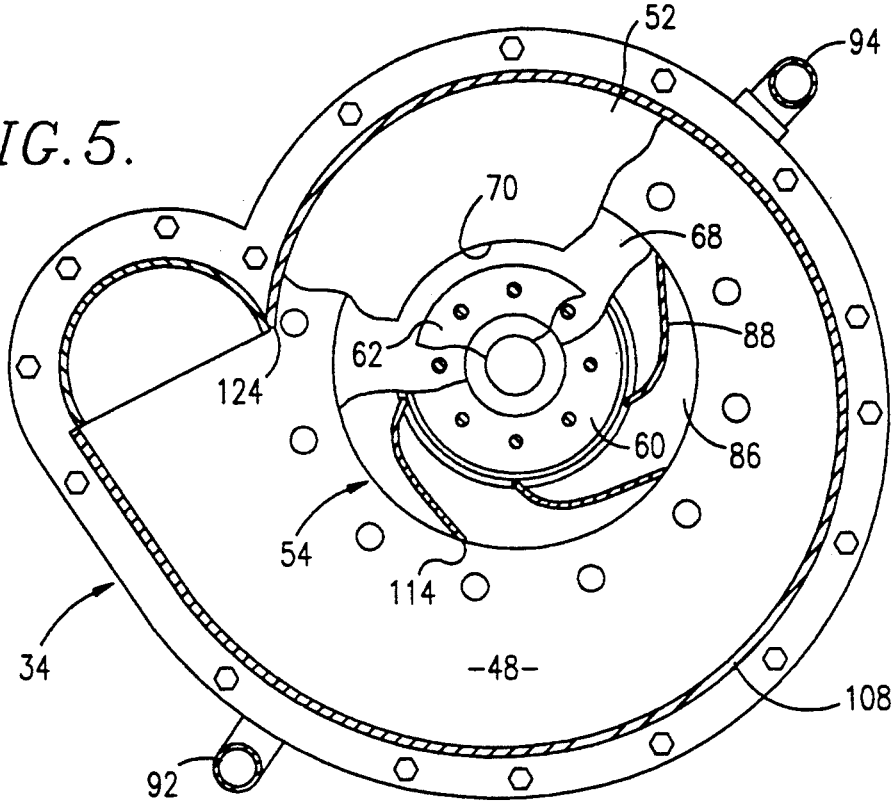
FIG. 5 is an enlarged horizontal cross-sectional view taken along line 5—5 of FIG. 4 with fragmentary portions of the housing also shown, illustrating the bottom of the housing and the primary impeller.

Referring now to the drawing, a pump 10 for handling abrasive materials is especially adapted for use with a floating platform 12 for conducting dredging operations from the water surface. Thus, a dredging system 14 employing the pump 10 includes floating platform 12 carrying a power supply such as diesel engine 16 and having a support 18 for discharge conduit 20 and a winch 21 and cable 22 for adjusting the depth of the pump 10. The engine 16 provides power for the hydraulically energized pump 10 and cutterhead 24 mounted next to the primary intake of the pump 10. The pump 10 is designed to be submersed in water 26 proximate a deposit of sand or other abrasive material 28.

The pump 10 hereof is shown in greater detail in FIG. 2. The pump 10 includes hydraulic motor 30 connected to a hydraulic drive associated with diesel engine 16 by hydraulic fluid conduit 32, and cutterhead 24 also includes a hydraulic motor 11 connected to a hydraulic drive associated with diesel engine 16 by a hydraulic fluid conduit 36. The pump 10 includes an outlet 38 which is provided with a flange 40 for connecting to discharge conduit 20.

Cutterhead 24 is provided with a plurality of rotatable blades 42 for engaging a deposit of sand, rock, muck or other abrasive material 28 to be dredged. The cutterhead 24 is positioned adjacent the primary inlet 44 of the pump 10 so that the abrasive material 28 may be drawn into the pump 10 without excessive clouding of the water 26. As shown in FIG. 2, the blades 42 of the cutterhead 24 are rotatable about a horizontal axis in a clockwise or counter-clockwise direction as shown therein, which serves to maintain an acceptable concentration of abrasive material entering the primary inlet.

Figure 3:
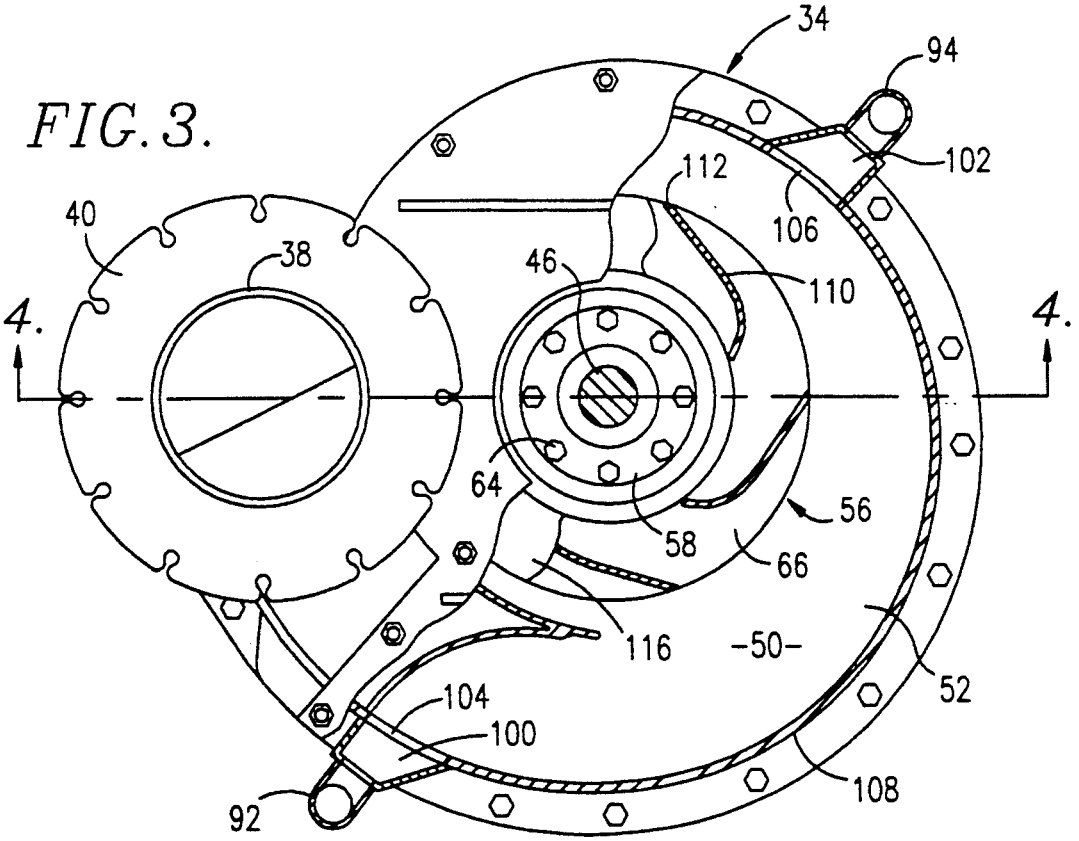
FIG. 3 is an enlarged top plan view of the pump hereof with portions of the housing broken away for clarity, and portions of the housing, shaft and secondary impeller of the pump shown in section.

Pump 10 also includes a housing 34 for enclosing the working components of the pump 10. As shown in FIG. 3, the housing is substantially volute in shape and houses a shaft 46. Referring now to FIG. 4, the housing 34 defines a first chamber 48 and a second chamber 50 separated by a dividing member 52 which is oriented in a plane substantially transverse to the axis of rotation of the shaft 46. The shaft 46 is connected to a primary, high-volume impeller 54 and a secondary, high-pressure impeller 56 by hub sections 58 and 60 and separated by spacer ring 62. Hub section 60 is provided with a series of evenly spaced internally threaded holes for receiving carriage bolts 64, thereby securing the hub sections, spacer ring and impellers together for simultaneous rotation with shaft 46. Housing 34 presents a primary inlet 44 is located on the normally lower side of housing 34 next to primary impeller 54, and a secondary inlet 65 adjacent secondary impeller 56 located on the opposite, normally upper side of the housing 34.

The housing 34, primary impeller 54, secondary impeller 56, and spacer ring 62 define a flowpath 63 for enabling liquid, and specifically relatively abrasive-free water; to flow from second chamber 50 into first chamber 48. As may be seen in FIG. 4, the annular baseplate 66 of secondary impeller 56 is spaced from dividing member 52, and the annular baseplate 68 of the primary impeller 54 is located on the opposite side of the dividing member 52 and similarly spaced therefrom. The spacer ring 62 presents a smaller outer diameter than the inner margin 70 of dividing member 52 thus enabling relatively abrasive-free water to flow from second chamber 50 into first chamber 48.

A purge ring 72 is located adjacent primary inlet 44 and presents a generally annular opening 74 therein. The annular opening 74 is defined by inner wall 76, outer wall 78 and bottom wall 80. In addition, the annular opening 74 is interrupted by barriers 82 and 84 to prevent the liquid therein from swirling into a cyclonic flow initiated by the primary impeller 54. The primary impeller 54 includes a front ring 86 opposite baseplate 68 which together support the primary impeller blades 88 therebetween. The purge ring 72 surrounds the primary inlet 44 and a face plate 90 is located forwardly and thus normally below the purge ring 72 for mounting cutterhead 24 thereon.

Purge ring 72 is fluidically connected to second chamber 50 by a pair of diametrically opposed channels 92, 94. The channels 92, 94 fluidically connect second chamber 50 with annular opening 74 of purge ring 72. The channels 92, 94 are located to a input a part of the flow generated by secondary impeller 56 adjacent barriers 82 and 84 respectively in a substantially radially inward direction. Ports 96, 98 are connected to channels 92 and 94 respectively by hoses 99 and are positioned so that they are angularly ahead of the direction of rotation of the adjacent primary impeller 54. That is to say, if primary impeller 54 is rotating in a counterclockwise direction as shown in FIG. 6, the ports 96, 98 will be immediately clockwise of the respective adjacent barriers 82, 84.

Channels 92, 94 receive a portion of the water flow from second chamber 50 as shown in FIG. 5. Receptacles 100, 102 receive a flow of relatively abrasive-free water generated by secondary impeller 56 through holes 104, 106 in the housing 34. The shell 108 of the housing 34 is bolted together and generally volute in shape, and holes 104, 106 are the only openings in the shell 108 in fluid communication with second chamber 50 through which water or other liquid received from secondary inlet 65 may flow other than through flowpath 63. The secondary impeller blades 110 have outer margins 112 which extend a greater radial distance from the axis of rotation of shaft 46 than the outer margins 114 of primary impeller blades 88 as may be appreciated from a comparison of FIGS. 3 and 5. Secondary impeller 56 is also provided with an annular ring 116 whereby impeller blades 110 are located between the annular ring 116 and baseplate 66.

The components of pump 10, with the exception of hoses 99, are preferably constructed of steel. However, cast iron construction, hardened, or lined materials are suitable alternative materials for construction. The steel components may be cast or individually fabricated. The components are painted prior to use to minimize the effects of corrosion to such elements as salt water.

In operation, the pump 10 hereof is lowered by winch 21 and cable 22 into position where it is immersed in a body of liquid such as water 26 and presenting cutterhead 24 and primary inlet 44 in proximity to a deposit of abrasive material 28 such as rock, sand, muck, or any other material. The abrasive material 28 is conventionally encountered as a deposit which is in the form of sediment or a rock formation. The pump 10 and cutterhead 24 are energized by the flow of hydraulic fluid through conduits 32 and 36, which in turn causes shaft 46 to rotate and drive primary impeller 54 and secondary impeller 56.

As the cutterhead blades 42 begin to rotate in a clockwise direction (viewed in FIG. 2), the deposit of abrasive material 28 is loosened and portions are brought near primary inlet 44. The rotation of the primary impeller 54 creates a suction drawing both water 26 and abrasive material 28 in through the primary inlet 44.

The secondary impeller 56 rotates simultaneously with the primary impeller 54 and draws relatively abrasive-free water 26 through secondary inlet 65. The abrasive-free water enters secondary chamber 50 and is diverted into two flows. The secondary impeller 56 presents a greater outside diameter than the primary impeller 54, but is of a narrower width than primary impeller 54, so that the volume of liquid pumped by the secondary impeller 56 is less, but moves at a higher velocity and has a higher pressure than that pumped by primary impeller 54. As a result, the water in second chamber 50 is at a higher pressure than the combination of water and abrasive material in first chamber 48 and consequently seeks to move thereto.

A portion of the water in chamber 50 is routed through channels 92 and 94 into purge ring 72. There, it is introduced into annular opening 74 for movement in a direction which is radically inward and upward to pass in the spaces 118 and 120 between the front ring 86 and the outer wall 78 and inner wall 76 respectively. This portion of the flow which passes through ports 96 and 98 thus serves to isolate the primary impeller 54 and the top margin 122 of the purge ring 72 from wear due to the intake of abrasive material through primary inlet 44. The radially inward orientation of the ports 96 and 98 and the barriers 82 and 84 resist the tendency of the primary impeller 54 to cause a cyclonic flow of water in the annular opening 74 and instead provide for the preferred radial flow of the water toward spaces 118 and 120.

A second part of the water in chamber 50 moves behind baseplate 66 of the secondary impeller 56 and through flowpath 63 to further isolate the primary impeller 54 from wear due to contact with abrasive material 28. This second part is especially effective in limiting any wear between the primary impeller 54 and the housing 34. The water moving through flowpath 63 and through channels 92 and 94 combines with the mixture of abrasive material and water entering primary inlet 44. The resulting slurry is a combination of the flows and moves through first chamber 48 and through outlet 38 to discharge conduit 20 for removal to a remote site.

It may be appreciated that while the primary inlet 44 will be exposed to a high concentration of abrasive material 28, the secondary inlet 65 is positioned on the opposite side of the housing 34 so that the water received therein is relatively abrasive-free. Should high turbity be encountered near the pump or cutterhead, the secondary inlet 65 may be cowled as much as 10 to 20 feet away so that the intake of water therein is free of abrasive material. The cutterhead 24 is located immediately adjacent the primary inlet 44 so that the abrasive deposits dislodged thereby are quickly sucked into the pump 10 through the primary inlet 44. Very little clouding of the surrounding water is caused by the pump 10 and the method of dredging described herein.

Yet further, in the event that the primary inlet 44 becomes temporarily covered due to engagement with an abrasive deposit or is covered by trash of some sort such as a plastic sheet, the pump 10 hereof does not choke because the secondary inlet 65 is oriented to continue to receive a supply of water 26 to maintain positive flow in the pump. Water received into the secondary inlet 65 is routed through the pump for discharge through a common outlet 38, and thus there is no loss of liquid. Choking also often occurs due to inadequate flow adjacent and downstream of the tongue of the pump, and again the secondary impeller 56 serves to maintain a positive flow of fluid even when the area adjacent the tongue 124 of the first chamber 48 becomes choked.

We claim:

1. A pump for abrasive materials comprising:

a rotatable shaft defining an axis of rotation;

a first impeller operably connected to said shaft for generating a primary flow of liquid;

a second impeller operably connected to said shaft for generating a secondary flow of liquid;

a housing adapted to rotatably receive said first impeller and said second impeller therein, said housing defining a first chamber for receiving said first impeller and presenting a primary inlet for receiving a liquid including abrasive materials, a second chamber for receiving said second impeller and presenting a secondary inlet located remotely on said housing from said first inlet for receiving a liquid relatively free of abrasive materials, said housing having an outlet remote from said primary inlet and said secondary inlet; and a first channel for diverting a part of the secondary flow of liquid from the second chamber to an area of the housing immediately adjacent the primary inlet.

2. A pump for abrasive materials as set forth in claim 1, said first channel being exterior to said housing.

3. A pump for abrasive materials as set forth in claim 2, including a purge ring presenting an annular opening in fluidic communication with said first channel and mounted adjacent the primary inlet for directing a flow of the relatively abrasive-free liquid toward said first impeller.

4. A pump for abrasive materials as set forth in claim 3, wherein said impeller includes a front edge, said annular opening being oriented for directing a flow of the relatively abrasive-free liquid toward said front edge.

5. A pump for abrasive materials as set forth in claim 4, including a second channel in fluidic communication with the annular opening of the purge ring, said second channel fluidically interconnecting said second chamber and the purge ring in opposite orientation to said first channel.

6. A pump for abrasive materials as set forth in claim 5, wherein said first and second channels are oriented for directing a flow of relatively abrasive-free liquid radially inwardly into the annular opening.

7. A pump for abrasive materials as set forth in claim 6 wherein said purge ring includes a least one barrier positioned across said annular opening to resist induced swirling of the fluid introduced therein.

8. A pump for abrasive materials as set forth in claim 1, said housing including a member dividing said housing into said first and second chambers, said member being oriented substantially perpendicular to the axis of rotation of said shaft.

9. A pump for abrasive materials as set forth in claim 8, said member lying between said first impeller and said second impeller and defining a flowpath for a part of the flow of the relatively abrasive-free material between said first impeller and said member and said second impeller and said member.

10. A pump for abrasive materials as set forth in claim 9, including a spacing ring positioned between said first and said second impeller, said spacing ring being substantially co-planar with said member, said flowpath including an annular space between the member and the spacing ring for the movement of the relatively abrasive-free liquid therethrough.

11. A submersible pump for abrasive materials comprising:

a rotatable shaft defining an axis of rotation;

a first impeller operably connected to said shaft for generating a primary flow of liquid and presenting a central region and a first outer periphery;

a second impeller operably connected to said shaft for generating a secondary flow of liquid, said second impeller having a diameter greater than and a depth smaller than said first impeller, said second impeller presenting a central region and a second outer periphery;

a housing rotatably receiving said first impeller and said second impeller therein, said housing defining a first chamber for receiving said first impeller and presenting a primary inlet adjacent and in communication with the central region of said first impeller for receiving a liquid including abrasive materials from ambient liquid in which the pump is immersed, and a second chamber for receiving said second impeller and presenting a secondary inlet located remotely on said housing and adjacent and in communication with the central region of said second impeller for receiving a liquid relatively free of abrasive materials from the ambient liquid in which said pump is immersed, said primary and secondary inlets being oriented in generally opposed relationship on opposite sides of said first and second impellers for respectively receiving said abrasive-including liquid and said relatively abrasive-free liquid directly from the ambient liquid;

means defining a passageway for said abrasive-free liquid for directing the latter from said central region of said second impeller radially outwardly and around said second periphery, radially inwardly from said second periphery in proximity to said first impeller, and then radially outwardly again towards said first periphery; and means defining an outlet remote from said primary inlet and said secondary inlet and in communication with the interior of said housing.

12. A pump for abrasive materials as set forth in claim 11, including a purge ring presenting an annular opening substantially surrounding said primary inlet for receiving a flow of the relatively abrasive-free liquid and directing said flow of abrasive-free liquid proximate said first impeller.

13. A pump for abrasive materials as set forth in claim 12 wherein said first impeller includes a front edge, said annular opening being oriented for directing a flow of the relatively abrasive-free liquid toward said front edge.

14. A pump for abrasive materials as set forth in claim 13 including first and second channels fluidically connecting said second chamber and said purge ring at relatively opposed positions on said purge ring.

15. A pump for abrasive materials as set forth in claim 14 wherein said first and second channels are oriented for directing a flow of relatively abrasive-free liquid radially inwardly into the annular opening.

16. A pump for abrasive materials as set forth in claim 15 wherein said purge ring includes at least one barrier positioned across said annular opening to resist induced swirling of the fluid introduced therein.

17. A pump for abrasive materials as set forth in claim 11, there being a fixed wall between said first and second impellers.

18. A method of dredging abrasive materials including the steps of:

immersing a pump having a housing including a primary inlet and a secondary inlet, said housing enclosing a first and second impeller in respective communication with the primary and secondary inlet into a liquid and positioning said pump in proximity to a deposit of abrasive material;

directing a first flow of the liquid including a quantity of the abrasive material into the primary inlet of the pump;

directing a second flow of the liquid which is relatively free of the abrasive material into the secondary inlet of the pump;

circulating a first portion of the second flow from the second impeller toward the first impeller proximate the primary inlet for reducing abrasion on the pump housing proximate the primary inlet during intake of the abrasive material;

circulating a second portion of the second flow from the second impeller through the housing proximate the first impeller and remote from the primary inlet for reducing abrasion on the pump during pumping of the abrasive material; and combining said first flow and said first portion and said second portion of said second flow in the housing and discharging the combined flow to a location remote from the pump.

19. A method of dredging abrasive materials as set forth in claim 18 including disrupting the deposit of abrasive material prior to directing the first flow into the primary inlet.

20. A method of dredging abrasive materials as set forth in claim 19 wherein said disrupting step includes rotating a cutter head into a deposit of abrasive materials in proximity to the primary inlet.

21. A method of dredging abrasive materials as set forth in claim 19 wherein said primary inlet is located for receiving the first flow relatively proximate the deposit of abrasive materials, and the secondary inlet is located for receiving the second flow remote from the deposit of abrasive materials relative to the primary inlet.

* * * * *